US009401567B2

(12) United States Patent
Miyoshi

(10) Patent No.: US 9,401,567 B2
(45) Date of Patent: Jul. 26, 2016

(54) CONNECTOR HAVING A FIRST METAL MEMBER WITH A BULGING PORTION CONTACTING A SECOND METAL MEMBER

(71) Applicant: Hosiden Corporation, Yao (JP)

(72) Inventor: Toshiharu Miyoshi, Yao (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 14/643,744

(22) Filed: Mar. 10, 2015

(65) Prior Publication Data

US 2015/0263457 A1 Sep. 17, 2015

(30) Foreign Application Priority Data

Mar. 13, 2014 (JP) ..... 2014-050120

(51) Int. Cl.

| | |
|---|---|
| ***H01R 13/648*** | (2006.01) |
| ***H01R 13/6581*** | (2011.01) |
| ***H01R 13/506*** | (2006.01) |
| ***H01R 13/6594*** | (2011.01) |
| *H01R 12/72* | (2011.01) |

(52) U.S. Cl.

CPC ..... *H01R 13/6581* (2013.01); *H01R 13/506* (2013.01); *H01R 13/6594* (2013.01); *H01R 12/724* (2013.01)

(58) Field of Classification Search

CPC . H01R 13/648; H01R 13/658; H01R 13/6581
USPC ..... 439/607.27, 607.28
See application file for complete search history.

(56) References Cited

U.S. PATENT DOCUMENTS

| | | | | |
|---|---|---|---|---|
| 7,771,235 | B2 * | 8/2010 | Kameyama | H01R 13/648 439/607.27 |
| 8,636,545 | B2 * | 1/2014 | Chow | H01R 13/514 439/607.27 |
| 8,961,230 | B2 * | 2/2015 | Chou | H01R 9/032 439/607.27 |
| 2010/0003852 | A1 * | 1/2010 | Myer | H01R 13/741 439/607.17 |
| 2010/0022132 | A1 * | 1/2010 | Wang | H01R 13/65802 439/607.27 |
| 2010/0035465 | A1 * | 2/2010 | Wang | H01R 13/502 439/541.5 |
| 2013/0059472 | A1 * | 3/2013 | Saito | H01R 13/648 439/607.27 |
| 2014/0357122 | A1 * | 12/2014 | Zheng | H01R 13/6581 439/607.27 |

FOREIGN PATENT DOCUMENTS

| | | | |
|---|---|---|---|
| EP | 2827459 | A1 | 1/2015 |
| JP | 8306435 | A | 11/1996 |
| JP | 2006310164 | A | 11/2006 |
| JP | 200970752 | A | 4/2009 |

* cited by examiner

*Primary Examiner* — Chandrika Prasad
(74) *Attorney, Agent, or Firm* — The Webb Law Firm

(57) ABSTRACT

Provided is a connector having a double shielded construction, which connector, though simple in its configuration, can improve the EMI characteristics reliably. The connector includes a contact to be electrically connected to a connecting object, a first insulating member having a front end portion to which the connecting object is connected and a rear end portion opposed to the front end portion, the first insulating member holding the contact, a first metal member covering the first insulating member, a second insulating member holding the first metal member, and a second metal member covering the first metal member and the second insulating member. The first metal member forms a bulging portion which bulges outwards from an outer face of the rear end portion, thus being in contact with the second metal member.

12 Claims, 6 Drawing Sheets

CONNECTOR HAVING A FIRST METAL MEMBER WITH A BULGING PORTION CONTACTING A SECOND METAL MEMBER

CROSS REFERENCE TO RELATED APPLICATION

This application is based on and claims priority under 35 U.S.C. Section 119 to Japanese Patent Application No. 2014-050120 filed on Mar. 13, 2014, the entire content of which is incorporated herein by reference.

BACKGROUND OF THE INVENTION

1. Field of the Invention

This disclosure relates to a connector to be electrically connected to a connecting object, more particularly to a connector having a plurality of metal shells.

2. Description of Related Art

Conventionally, in order to improve EMI (electro-magnetic interference) characteristics of a connector, there is known one having a double-shielded construction as disclosed in e.g. Japanese Unexamined Patent Application Publication No. 2009-70752. This connector includes a contact, a first insulating member (an inner housing) holding the contact, a first metal member (an inner shell) covering the first insulating member, a second insulating member (an outer housing) disposed outside the first metal member, and a second metal member (an outer shell) covering the second insulating member.

Japanese Unexamined Patent Application Publication No. 2009-70752 further discloses a technique for enhancement of shielding performance in which a leading end of a contact piece formed by inward bending of a portion of the second metal member is placed in contact with the first metal member in a direction perpendicular to a connecting direction of the connecting object. As contact between the first metal member and the second metal member is formed on the connector side, need for forming such electric connection therebetween on the circuit board side can be eliminated, thus allowing higher degree of designing freedom for the circuit board.

SUMMARY OF THE INVENTION

However, in the case of the connector disclosed in Japanese Unexamined Patent Application Publication No. 2009-70752, the contact between the leading end of the contact piece of the second metal member and the first metal member is a line contact having limited contact area, so that there remains room for improvement for the purpose of EMI characteristics improvement contemplated. Further, since the contact between the first metal member and the second metal member is formed along the direction perpendicular to the connecting direction of the connecting object, it is difficult for a pressing force applied to the connecting object to be reflected in its contact force. Furthermore, with such line contact described above, contact failure tends to occur between the first metal member and the second contact member in the event of e.g. development of corrosion in the metal member(s) due to moisture or application of a strong vibration thereto along the perpendicular direction, so that a desired shielding effect may not be obtained.

According to a preferred embodiment of the present disclosure, there is provided a connector having a double shielded construction, which connector, though simple in its configuration, can improve the EMI characteristics reliably.

According to a preferred embodiment of a connector relating to the present disclosure, the connector comprises:

a contact to be electrically connected to a connecting object;

a first insulating member having a front end portion to which the connecting object is connected and a rear end portion opposed to the front end portion, the first insulating member holding the contact;

a first metal member covering the first insulating member;

a second insulating member holding the first metal member;

a second metal member covering the first metal member and the second insulating member; and the first metal member forming a bulging portion which bulges outwards from an outer face of the rear end portion, thus being in contact with the second metal member.

In this embodiment, as there is provided a bulging portion which bulges outwards from the outer face of the first metal member covered by the second metal member, this bulging portion comes into contact with an inner face of the second metal member. Namely, as the embodiment employs the configuration of causing the outer face of the first metal member to bulge, rather than bending the second metal member for forming line contact with the first metal member, the shape of the bulging portion can be set as desired. For instance, through e.g. increase in the contact area between the first metal member and the second metal member or adjustment of the thickness of the bulging portion for ensuring desired force of contact, reliable contact between the first metal member and the second metal member is made possible.

Moreover, in the first metal member, the bulging portion is formed in its outer face on the side of the rear end portion opposed to the front end portion to which the connecting object is to be connected. Accordingly, the direction of contact of the first metal member via its bulging portion with the second metal member is in agreement with the direction of connecting the connecting object to the connector. That is, a pressing force used for establishing connection of the connecting object to the first insulating member is transmitted via this first insulating member to the first metal member and also to the second metal member contacting the first metal member. Therefore, this pressing force serves as a compression force for providing elastic deformation of the bulging portion of the first metal member, so that firm contact can be formed between the first metal member and the second metal member. Further, in the event of exposure to a strong vibration in the direction perpendicular to the connecting direction of the connecting object, no or little force associated with this vibration will be applied in the direction perpendicular to the direction of the face of contact between the first metal member and the second metal member. Consequently, contact failure will hardly occur between the first metal member and the second metal member, so that the contact between the first metal member and the second metal member can be maintained in a reliable manner.

With the simple configuration of forming a bulging portion as provided in the above embodiment, it is possible to realize reliable contact between the first metal member and the second metal member and to improve the EMI characteristics against e.g. high-frequency noise.

According to a preferred embodiment of the connector relating to the present disclosure, the bulging portion is provided in the form of a face.

If the bulging portion is provided in the form of a face as proposed in the above embodiment, face contact is formed between the first metal member and the second metal member, thus realizing increased contact area therebetween and even further improvement in the EMI characteristics.

According to a further preferred embodiment of the present disclosure, the second insulating member includes a groove formed in a direction perpendicular to a connecting direction of the connecting object; and the second metal member includes an inwardly projecting portion which is fitted within the groove.

According to this embodiment, along the direction perpendicular to the connecting direction of the connecting object, the second metal member will be attached to the second insulating member. Namely, the projecting portion of the second metal member will be guided along the groove of the second insulating member. In this, through adjustment of thickness of the bulging portion of the first metal member so as to cause outward elastic deformation of the second metal member, firm contact can be realized between the first metal member and the second metal member. Moreover, since the second metal member is attached in the direction perpendicular to the connecting direction of the connecting object, positional error will hardly occur in association with insertion/withdrawal of the connecting object. Therefore, the contact between the first metal member and the second metal member can be maintained for a long period of time.

According to a further preferred embodiment of the present disclosure, at the rear end portion of the first metal member, there is formed an abutment portion which abuts the second insulating member while being bound between the second insulating member and the second metal member, movement of the first metal member toward the front end portion is prevented by abutment of the abutment portion to the second insulating member.

According to the above embodiment, the abutment portion abutting the second insulating member prevents movement of the first metal member toward the front end portion. Therefore, inside the connector, the first metal member is bound between the second insulating member and the second metal member without positional error or displacement, so that inadvertent variation in the relative position will hardly occur between the first metal member and the second metal member, thus ensuring reliable contact therebetween.

According to a still further preferred embodiment of the present disclosure, the second insulating member is fitted over the first metal member along the connecting direction of the connecting object; and the abutment portion extends outwards from the rear end portion of the first metal member.

According to the above embodiment, since the abutment portion extends outwards from the rear end portion of the first metal member, the configuration requires only bending of an end of the first metal member. Thus, compared with an arrangement of providing a retaining member separately, the above configuration allows reduction in the number of assembly steps and costs. Further, when the second insulating member is fitted over the first metal member along the connecting direction of the connecting object, the abutment portion of the first metal member comes into contact with the second insulating member, thus being fixedly positioned relative thereto. Therefore, the assembly can be facilitated.

DETAILED DESCRIPTION OF THE INVENTION

Next, embodiments of a connector relating to the present disclosure will be explained with reference to accompanying drawings. In the present embodiment, there will be shown an example wherein contacts 4 of a connector C are electrically connected to a connecting object (not shown) and also to a circuit board K. It is understood, however, that the present disclosure is not limited to the embodiments as follows, but various modifications thereof will be possible as long as they will not depart from the essence thereof defined in the present disclosure.

Figure 1:
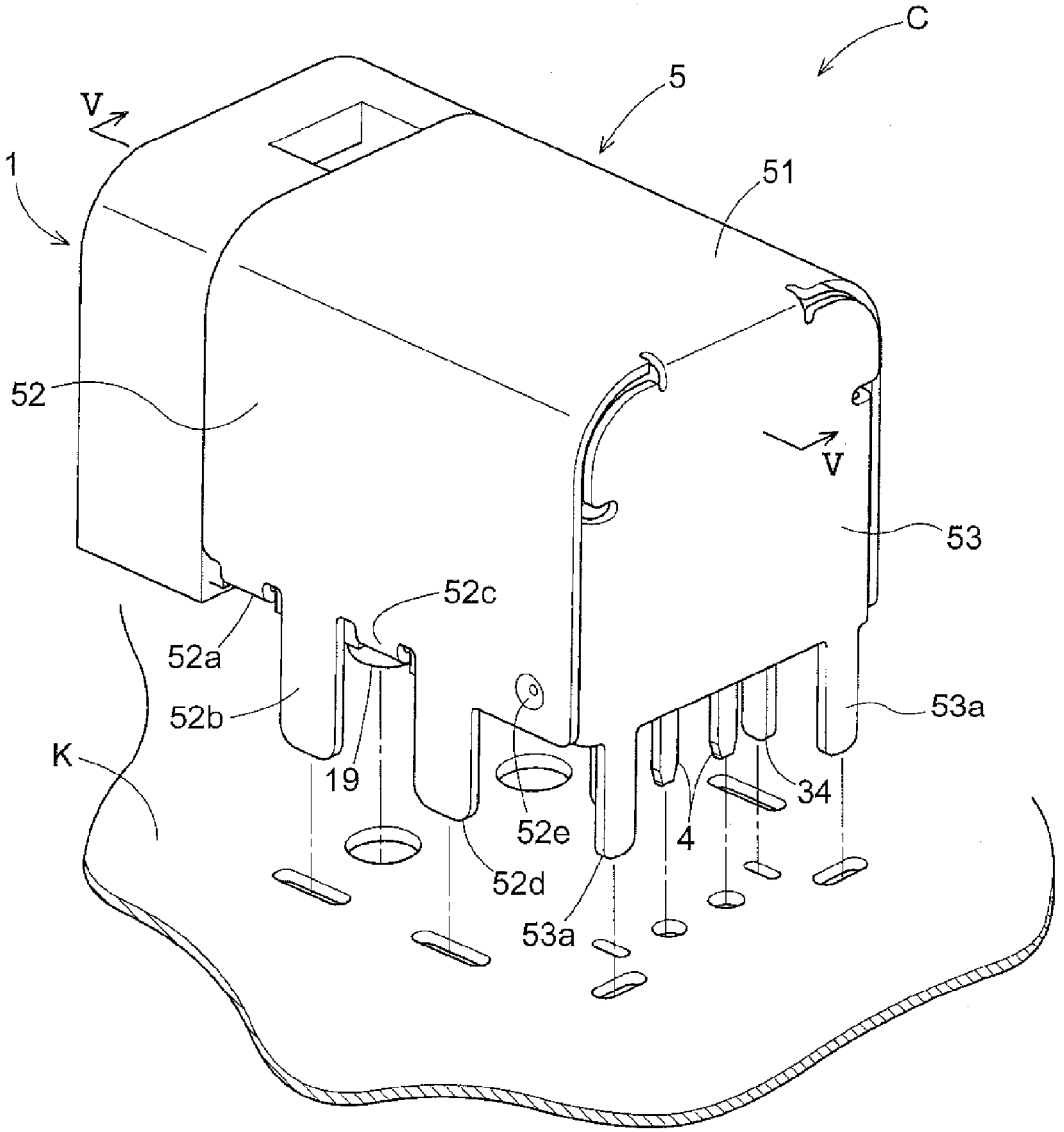
FIG. 1 is an upper perspective view of a connector.
Figure 2:
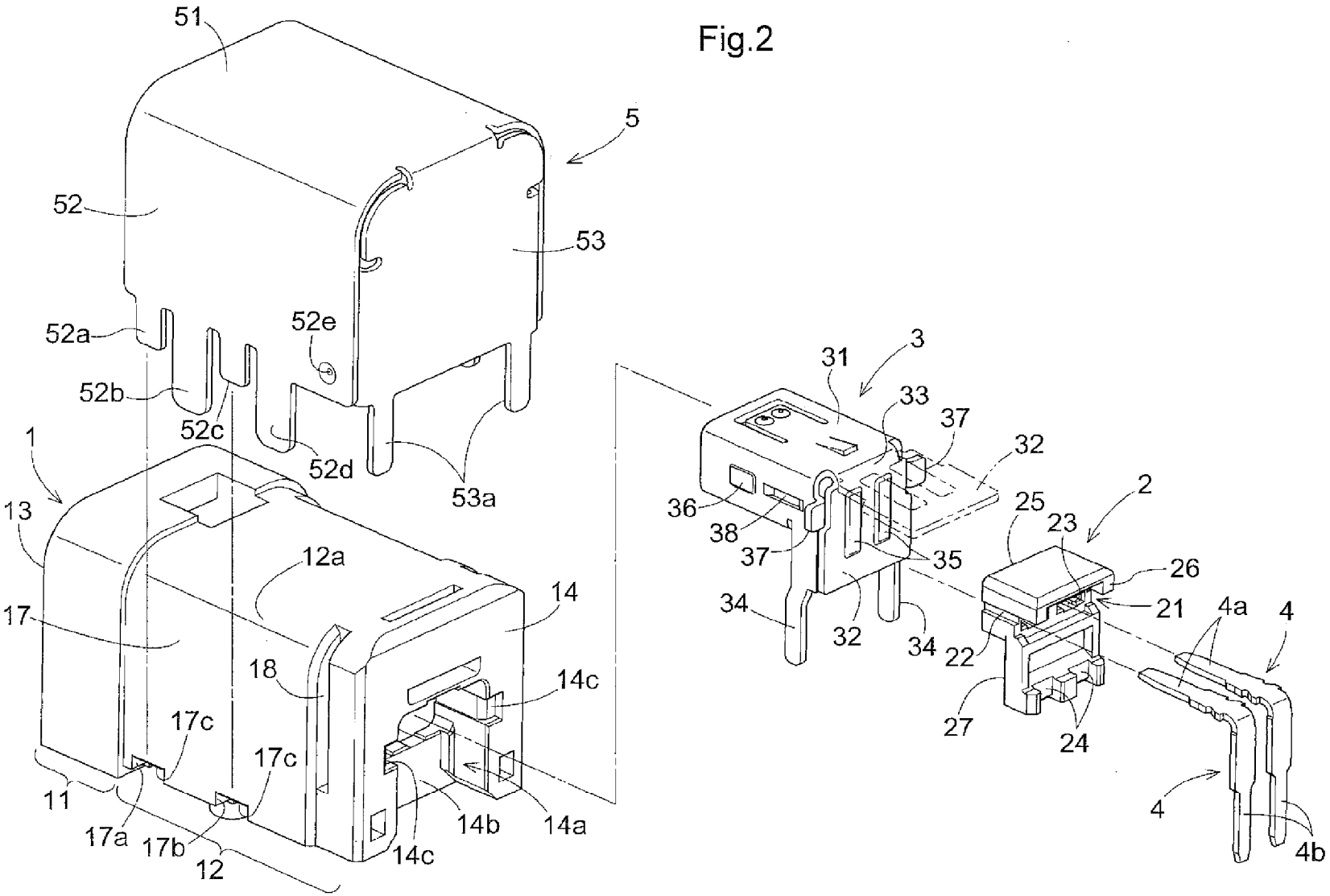
FIG. 2 is an exploded perspective view showing the connector as seen from its rear face side.
Figure 3:
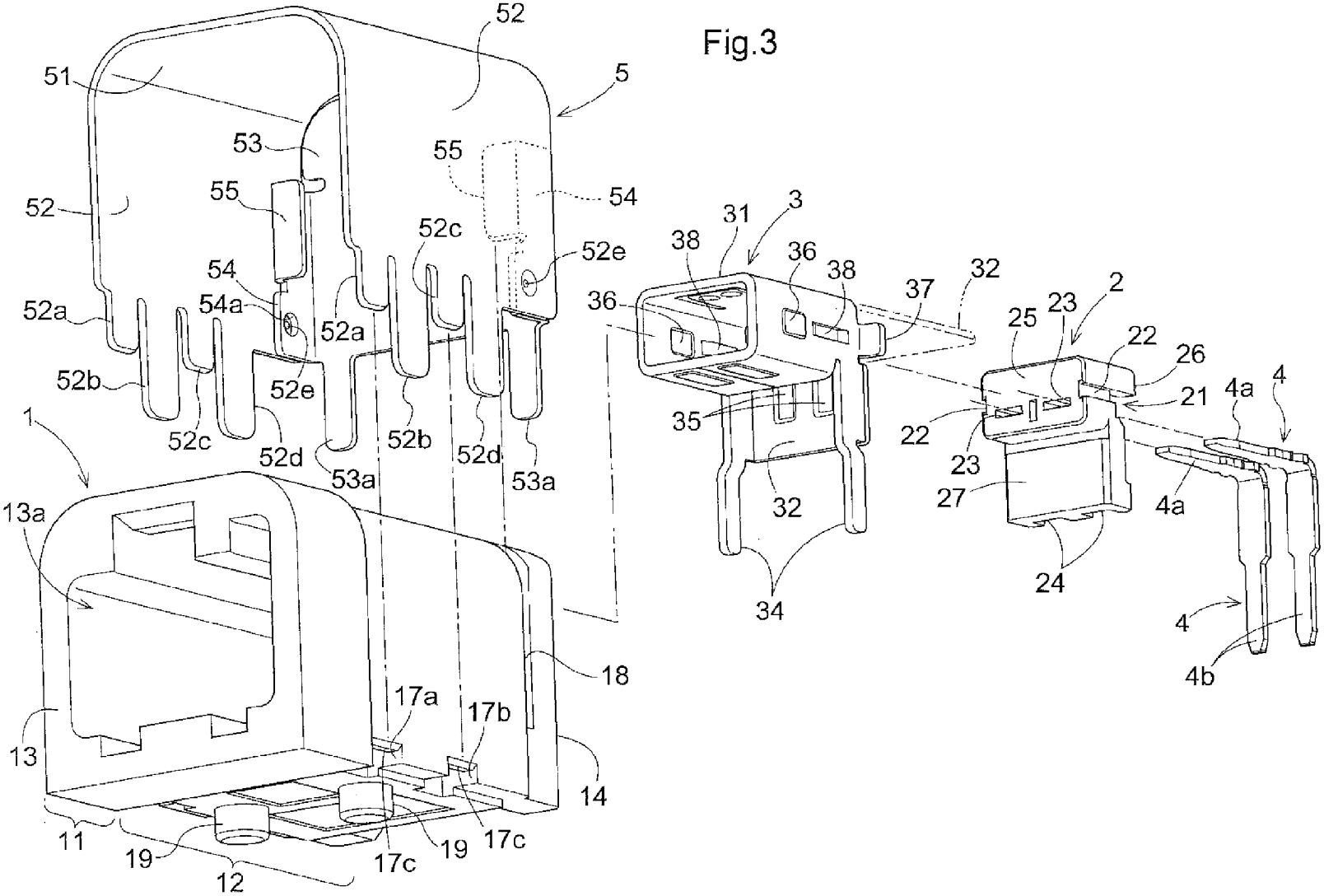
FIG. 3 is an exploded perspective view showing the connector as seen from its front face side.
Figure 4:
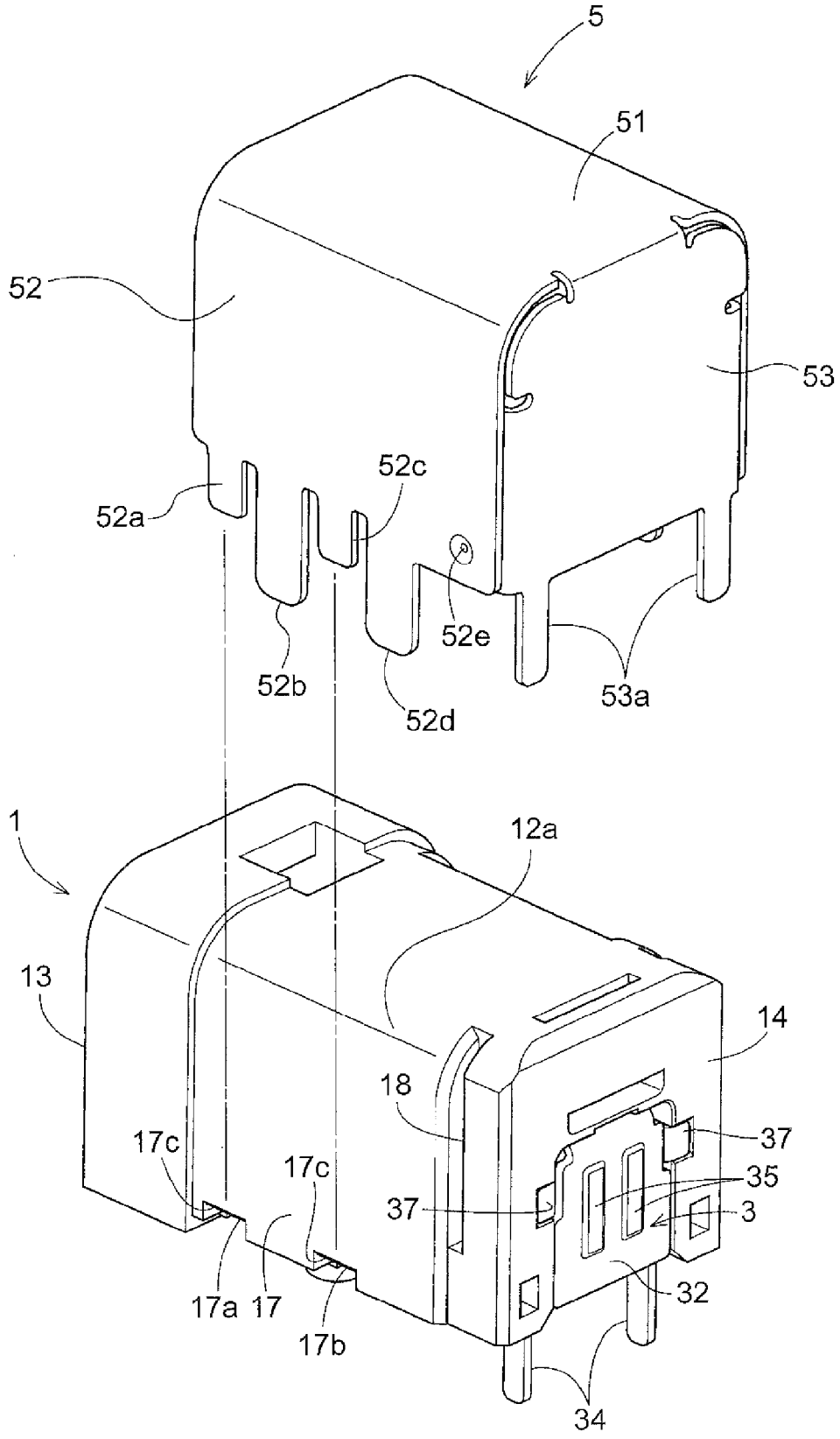
FIG. 4 is a partially exploded perspective view showing the connector as seen from its rear face side.
Figure 5:
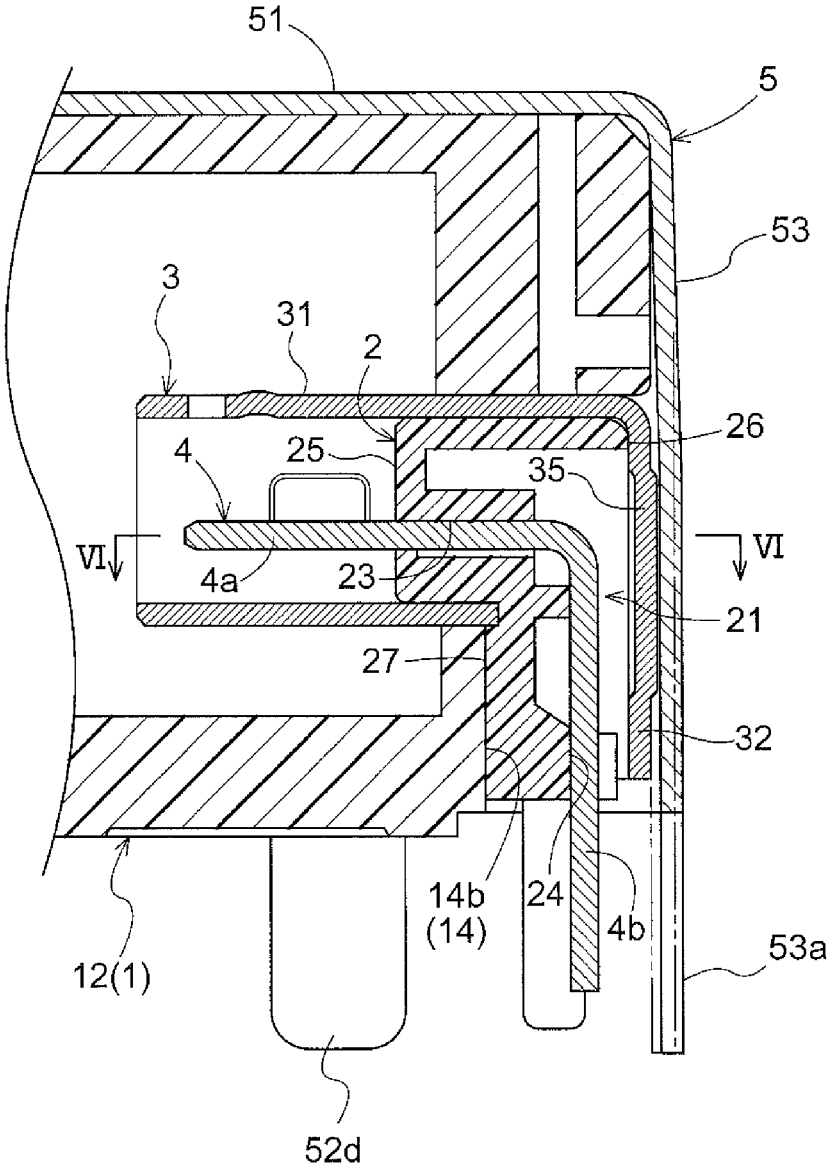
FIG. 5 is a side view in section showing the connector as seen in a direction V-V in FIG. 1.
Figure 6:
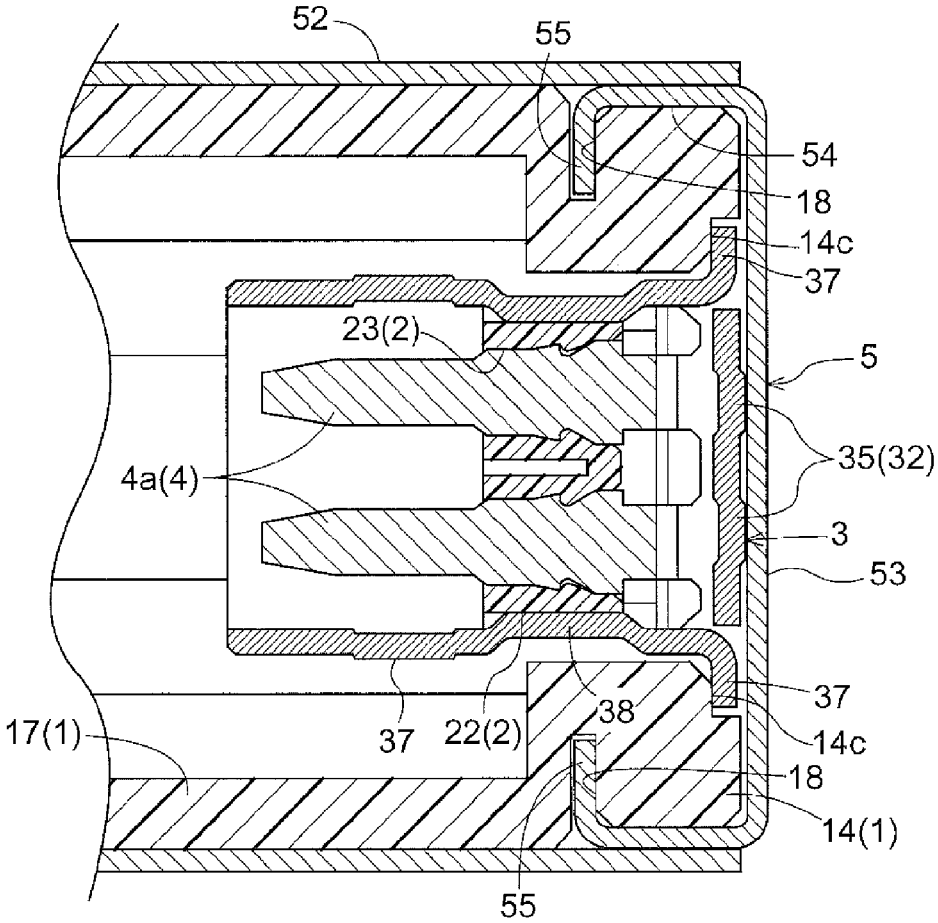
FIG. 6 is a section view showing the connector as seen in a direction VI-VI in FIG. 5.

FIG. 1 is an upper perspective view of the connector C in the instant embodiment. FIGS. 2 and 3 are an exploded perspective view showing the connector C as seen from its rear upper side and an exploded perspective view showing the connector C as seen from its front lower side. Further, FIG. 4 is a partially exploded perspective view showing the connector C as seen from its rear upper side, FIG. 5 is a side view in section showing the connector C and FIG. 6 is a section view showing the connector C as seen in a direction VI-VI in FIG. 5. In the following discussion, the side of the connector C which side is connected to the circuit board K will be defined as the lower side, and the opposite side thereto will be defined as the upper side, respectively. Further, the side thereof to which the connecting object is to be connected will be defined as the front side and the opposite side thereto will be defined as the rear side, respectively.

As shown in FIG. 2, the connector C includes the contacts 4 to be electrically connected to the connecting object, a second body 2 (an example of "first insulating member") holding the contacts 4, an inner shell 3 (an example of "first metal member") covering the second body 2, a first body 1 (an example of "second insulating member") holding the inner shell 3, and an outer shell 5 (an example of "second metal member") covering the first body 1 and the inner side shell 3. The second body 2 includes a front end portion 25 to which the connecting object is connected and a rear end portion 26 opposed (opposite) to this front end portion 25. The first body 1 and the second body 2 are formed of an insulating material such as resin, whereas the inner shell 3, the contacts 4 and the outer shell 5 are formed of a conductive material such as metal.

The first body 1 is provided in the form of a tubular (hollow) body and includes a connected portion 11 to which the connecting object is to be connected and a covered portion 12 covered by the outer shell 5. As shown in FIG. 3, at a front end portion 13 of the connected portion 11, there is formed a first opening 13*a* into which the connecting object is to be inserted. Further, as shown in FIG. 2, in the rear face constituting a rear end portion 14 of the covered portion 12, there is formed a second opening portion 14*a* into which the second body 2 and the inner shell 3 are to be inserted. Further, at the opposed lateral ends of the upper face of the covered portion 12, curved face portions 12*a* are provided.

At the lower center portion of the rear face of the covered portion 12, there is formed a cutout 14*b*. Also, the second opening portion 14*a* has its right and left opposed end portions formed concave, thus forming restraining portions 14*c* for preventing forward movement of the inner shell 3 by the abutment thereto when this inner shell 3 is inserted.

For the connecting object connected to the first opening portion 13*a*, its terminals to be connected come, inside the first body 1, into contact with the contacts 4 held to the second body 2, whereby electrical connection is formed between the terminals to be connected and the contacts 4.

The upper face of the covered portion 12 is formed lower than the upper face of the connected portion 1. Also, the covered portion 12 has lateral walls 17 on the opposed sides and in each of these opposed lateral walls 17, there are formed a first concave portion 17*a*, a second concave portion 17*b* and a groove 18 in this mentioned order from the front side.

The concave portions 17*a*, 17*b* are formed at two portions by cutting away the lower end of the lateral wall 17 by a predetermined width. Further, at the upper ends of the concave portions 17*a*, 17*b*, there are provided restraining faces 17*c* for restraining upward displacement of the outer shell 5.

The groove 18 is formed by cutting away the lateral wall 17 vertically elongate, from the curved face portion 12*a* to an intermediate position of the lateral wall 17.

In the lower face of the covered portion 12, there are formed two downwardly projecting bottom face projections 19 which are to be inserted into holes provided in the circuit board K.

In the lateral faces of the second body 2, there are formed guide grooves 22 acting as guides when the inner shell 3 is inserted from the front side. Further, in the rear face, as the rear side, of the second body 2, there is formed a rear end portion 26 to which a cover portion 32 of the inner shell 3 comes into contact and a concave portion 21 is formed from the rear end portion 26 downwards. Inside the concave portion 21, there are provided contact holes 23 and retaining grooves 24 for fixing the contacts 4. Further, the front end portion 25 of the second body 2 is formed in the form of a stepped-down portion, thus providing an abutment portion 27 to which the first body 1 abuts.

The contact holes 23 are formed through vicinity of the center of the front end face of the concave portion 21 to the front side of the second body 2. Further, inside the concave portion 21, retaining grooves 24 for holding the contacts 4 are provided in the form of vertically elongate grooves.

Each contact 4 includes a contacting portion 4*a* to come into contact with a terminal of the connecting object and an inserting portion 4*b* to be inserted into the circuit board K. In the instant embodiment, the inserting portion 4*b* is formed by bending so as to extend downwards from the rear end of the contacting portion 4*a*. The contact 4 will be held by the second body 2 with pressing of the contacting portion 4*a* into the contact hole 23 from the rear side of the second body 2 and fitting of the upper portion of the inserting portion 4*b* into the retaining groove 24.

The inner shell 3 includes a tubular portion 31, a cover portion 32 extending rearwards from the tubular portion 31, a bending portion 32 for bending the cover portion 32, and leg portions 34 extending downwards from the tubular portion 31.

The cover portion 32 includes rib portions 35 (an example of "bulging portions") bulging outwards (rearwards) from the outer face thereof to come into contact with the inner face of the rear side of the outer shell 5. In the instant embodiment, the rib portions 35 in the form of vertically elongate faces are provided on the right and left opposed sides of the cover portion 32. Though details will be given later, at the time of assembly of the outer shell 5, face contact is formed between these rib portions 35 and the inner face of the outer shell 5, that is, as the inner shell 3 and the outer shell 5 are in contact over a large area with each other, high-frequency wave transmission characteristics is improved. Further, since there is no need for the circuit board K to provide wiring to realize the connection between the inner shell 3 and the outer shell 5, there is obtained higher freedom in pattern designing of the circuit board K.

On the inner face of the lateral walls of the tubular portion 31, there are formed guiding projections 38 extending inwards to come into contact with the guide grooves 22 of the second body 2. The inner shell 3 will be inserted from the front side of the second body 2, with engagement between the guide grooves 22 and the guiding projections 38.

In the outer faces of the lateral walls of the tubular portion 31, at their approximately front/rear center, there are formed bulging portions 36 which bulge outwards. In operation, when the first body 1 is being fitted over the inner shell 3, guiding is provided as the recesses formed in the inner faces of the lateral walls 17 of the first body 1 come into engagement with the bulging portions 36. Further, at rear end portions of the lateral walls of the tubular portion 31, abutment portions 37 are formed to extend outwards to abut the restraining portions 14*c* provided in the second opening portion 14*a* of the first body 1. With this, forward movement of the inner shell 3 inside the connector C is prevented.

The leg portions 34 extend downwards from the opposed side ends of the cover portion 32 to be inserted into the holes provided in the circuit board K.

The inner shell 3, under the conditions illustrated in FIG. 2 and FIG. 3, are formed approximately at a right angle relative respectively to the upper face of the tubular portion 31 and the rear face of the cover portion 32; but prior to its attachment to the second body 2, the upper face of the tubular portion 31 and the upper face of the cover portion 32 are located on a same plane (the condition denoted with two-dotted lines). The cover portion 32 will be bent downwards at its bent portion 33 after engagement of the second body 2 having the contacts 4 pressed therein from the rear side of the inner shell 3. With this, as shown in FIG. 5, contact is established between the rear end portion 26 of the second body 2 and the inner face of the cover portion 32 of the inner shell 3.

The outer shell 5 is fitted over the covered portion 12 of the first body 1 from above. The outer shell 5 includes an upper face portion 51 covering the upper face of the covered portion 12, lateral walls 52 covering the lateral walls 17 of the covered portion 12, and a rear face portion 53 covering the rear face of the inner shell 3.

The lateral walls 52 of the outer shell 5 extend downwards from the opposed lateral ends of the upper face portion 51 of the outer shell 5. In this embodiment, the upper face portion 51 and the lateral walls 52 are formed by bending a single metal plate. In this, the opposed lateral ends of the upper face portion 51 have curved shapes to follow the contour of the curved face portions 12*a* of the first body 1. Further, in each of the opposed lateral walls 52 of the outer shell 5, there are formed a first projecting piece 52*a*, a first leg portion 52*b*, a second projecting piece 52*c*, a second leg portion 52*d* and a fixing portion 52*e* in this mentioned order from the front side.

The projecting pieces 52*a*, 52*c* are formed to extend from the lower end of the lateral wall 52 of the outer shell 5. After the outer shell 5 is fitted over the first body 1, the projecting pieces 52*a*, 52*c* are bent to be engaged with the concave portions 17*a*, 17*b* and fixed therein. In this, by the restraining faces 17*c* at the upper ends of the concave portions 17*a*, 17*b*, upward displacement of the outer shell 5 is restrained.

The leg portions 52*b*, 52*d* are formed to extend downwards from the lower ends of the lateral walls 52 to be inserted into the holes provided in the circuit board K.

The fixing portion 52*e* is provided downwardly of the rear end portion of the lateral wall 52 and formed as an inwardly projecting projection.

The rear face portion 53 of the outer shell 5 is formed to extend downwards from the rear end of the upper face portion 51. Further, the rear face portion 53 is formed by the same single metal plate forming the upper face portion 51 and the lateral walls 52 and the rear face portion 53 is formed by being bent downwards at the rear end of the upper face portion 51. Further, as shown in FIG. 3, the rear face portion 53 includes lateral portions 54, projecting portions 55, and third leg portions 53*a*. In this embodiment, as shown in FIG. 6, when the outer shell 5 is fitted over the first body 1, the inner face of the rear face portion 53 comes into face-contact with the rib portions 35 of the inner shell 3.

The lateral portions 54 are formed by being bent to extend forwardly from the opposed lateral ends of the rear face portion 53. Further, at lower portions of the lateral portions 54, fixed portions 54*a* to be fixed to the fixing portions 52*e* of the lateral walls 52 are provided in the form of through holes. In these through holes, the aforementioned projections provided in the lateral walls 52 of the outer shell 5 will be inserted, thus fixedly retaining the lateral walls 52 and the rear face portion 53 to each other.

The projecting portions 55 are formed to extend inwards from upper portions of the front end portions of the lateral walls 54. In the instant embodiment, each projecting portion 55 is formed as a plate-like projecting piece and is formed by being bent at the front end of the lateral wall 54. When the outer shell 5 is being fitted over the first body 1, the projecting portions 55 will be guided by the aforementioned grooves 18 of the first body 1.

The third leg portions 53*a* extend from the lower ends of the vicinity of the opposed lateral ends of the rear face portion 53 to be inserted into the holes provided in the circuit board K, like the leg portions 52*b*, 52*d*.

Next, there will be explained a method of assembling the connector C.

Firstly, as described above, after the contacts 4 are assembled with the second body 2, the inner shell 3 is fitted over the second body 2. Then, the second body 2 and the inner shell 3 assembled together are inserted to the second opening portion 14*a* of the first body 1. In this, as shown in FIG. 4, the rear face of the inner shell 3 is disposed on the same plane as the rear face of the first body 1. Further, as shown in FIG. 6, the abutment portions 37 of the inner shell 3 abut the restraining portions 14*c* of the first body 1 and also the abutment portion 27 of the second body 2 abuts the first body 1. With these, movement of the second body 2 and the inner shell 3 to the front side is restrained.

As shown in FIG. 1, under the condition in which the second body 2 and the inner shell 3 assembled together have been inserted into the first body 1, the inserting portions 4*b* of the contacts 4 and the leg portions 34 of the inner shell 3 extend downwards beyond the lower face of the connector C through the cutouts 14*b* of the first body 1. Further, on the lower face of the first body 1, there are provided the bottom face projections 19 projecting downwards. These are inserted into the holes provided in the circuit board K. With these, the first body 1 is fixed in position relative to the circuit board K; and the first body 1, the inner shell 3 and the contacts 4 are connected to the circuit board K.

Next, as shown in FIG. 4, the outer shell 5 is fitted from above over the covered portion 12 of the first body 1. In this, the projecting portions 55 of the outer shell 5 engage into the grooves 18. In the instant embodiment, the grooves 18 are formed along the direction perpendicular to the connecting direction of the connecting object. Therefore, even when the connecting object is inserted or withdrawn, the projecting portions 55 of the outer shell 5 come into contact with the inner faces of the grooves 18. Consequently, displacement of the outer shell 3 in the front/rear direction can be effectively prevented. In particular, in the instant embodiment, since each projecting portion 55 is provided in the form of a plate-like projecting piece which comes into face-contact with the inner face of the groove 18, the outer shell 5 and the first body 1 can be fixed even firmly to each other. Therefore, inadvertent withdrawal/removal of the outer shell 5 from the first body 1 can be prevented.

Further, in this embodiment, as shown in FIG. 3, the lateral portion 54 extends from the lateral end of the rear face 53 of the outer shell 5 and the projecting portion 55 projects from this lateral portion 54. Therefore, even when a force is applied to the projecting portion 55 in association with insertion/withdrawal of the connecting object, this force can be dissipated to the lateral portions 54 and the rear face portion 53 of the outer shell 5. Accordingly, thanks to high strength of the projecting portions 55, inadvertent withdrawal/removal of the outer shell 5 from the first body 1 can be effectively prevented. Incidentally, since the lateral portions 54 of the outer shell 5 are fixedly retained to the lateral walls 52 of the outer shell 5, the rear face portion 53 and the lateral walls 52 of the outer shell 5 are fixed to each other.

Moreover, after the outer shell 5 is fitted over the first body 1 and the projecting pieces 52*a*, 52*c* of the lateral walls 52 of the outer shell 5 are bent to engage into the concave portions 17*a*, 17*b* of the first body 1. With this, even when the connecting object is inserted or withdrawn, the projecting pieces 52*a*, 52*c* come into contact with the inner faces of the concave portions 17*a*, 17*b*, thus effectively preventing inadvertent withdrawal/removal of the outer shell 5 from the first body 1 in the front/rear direction. Further, as the projecting pieces 52*a*, 52*c* abut the restraining faces 17*c*, upward displacement of the outer shell 5 is effectively restrained. In these manners, the outer shell 5 and the first body 1 are firmly fixed to each other. Moreover, simultaneously with the fitting of the outer shell 5 over the first body 1, the leg portions 52*b*, 52*d*, 53*a* of the outer shell 5 are inserted into the holes provided in the circuit board K. With this, the circuit board K and the outer shell 5 can be fixed to each other.

Under the condition where the outer shell 5 is fitted over the first body 1, as shown in FIG. 5, the rear end portion 26 of the second body 2 comes into contact with the inner face of the cover portion 32 of the inner shell 3 and also the abutment portion 27 of the front end portion 25 of the second body 2 abuts the first body 1. Further, as shown in FIG. 6, the abutment portions 37 of the inner shell 3 abut the restraining portions 14*c* of the first body 1, and the rib portions 35 formed on the outer face of the cover portion 32 of the inner shell 3 come into contact with the inner face of the rear face portion 53 of the outer shell 5. With these, the second body 2 and the inner shell 3 are fixed in position relative to the first body 1 and the outer shell 5, thus preventing forward movement of the inner shell 3. Accordingly, even when the main body is comprised of a plurality of components, there is no need to provide any additional member for fixing these main body components to each other. Thus, the configuration can be made simple.

Moreover, when the outer shell 5 is to be fitted over the first body 1, as the rib portions 35 are provided on the outer side of the cover portion 32 of the inner shell 3, the rear face portion 53 is elastically deformed to the outer side (rear side). As a result, strong face contact is established between the rib portions 35 of the inner shell 3 and the rear face portion 53 of the outer shell 5, thus improving the EMI characteristics. Further, the pressing force used for connecting the connecting object to the second body 2 is transmitted via the rear end portion 26 of the second body 2 to the inner shell 3 and then to the outer shell 5. Therefore, a compressive force will be applied to cause elastic deformation of the rib portions 35 of the inner shell 3, whereby the rib portions 35 and the rear face 53 can be placed into firm contact with each other. Moreover, since the rib portions 35 extend in the direction perpendicular to the connecting direction of the connecting object, the pressing force applied to the connecting object is transmitted and also contact failure will hardly occur even in the event of vibration in the vertical direction. Incidentally, the rib portion 35 has its height, position and size adjusted such that the rib portion 35 can cause elastic deformation of the rear face portion 53 of the outer shell 5 and can also ensure reliable contact between the inner shell 3 and the outer shell 5.

Figure 7:
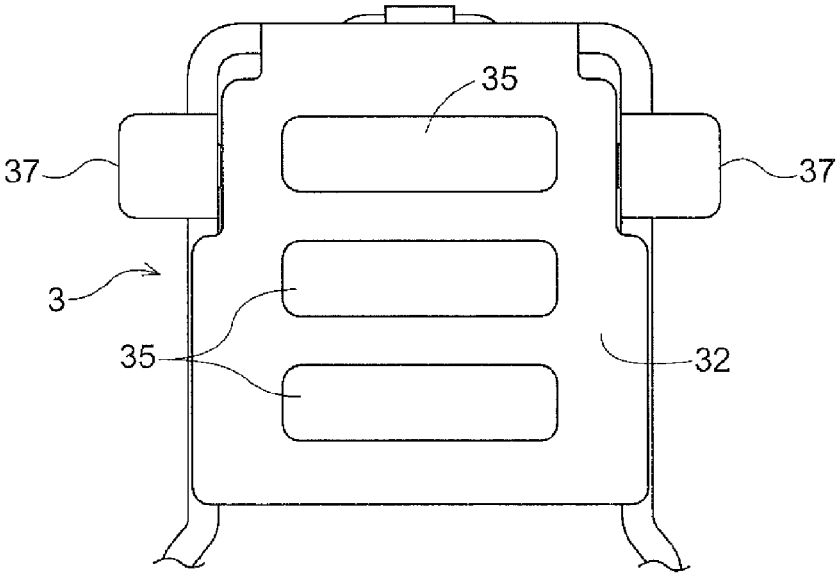
FIG. 7 is an enlarged view showing a rear face side of a first metal member in a further embodiment.

OTHER EMBODIMENTS (1) In the foregoing embodiment, on the right and left opposed sides of the cover portion 32, there were provided the rib portions 35 in the form of vertically elongate faces. Instead, as shown in FIG. 7, it is possible to provide a plurality of laterally elongate face-like rib portions 36 in the vertical direction of the cover portion 32. That is, the position, the number and the size of the rib portion 35 are not particularly limited, but may vary as long as face-contact and reliable contact can be ensured between the outer face of the inner shell 3 and the inner face of the outer shell 5.

(2) In the foregoing embodiment, the projecting portions 55 were provided to extend from the end portions of the lateral portions 54 extending from the rear face portion 53. Instead, as long as they engage into the grooves 18 of the first body 1, the projecting portions 55 can be provided at any portions of the outer shell 5. For instance, they may be provided in the lateral walls 52 of the outer shell 5.

(3) In the foregoing embodiment, the abutment portions 37 were provided to extend outwards from the rear end portion of the tubular portion 31 of the inner shell 3 to come into contact with the restraining portions 14*c* of the first body 1. Instead, as long as these portions are capable of restraining forward movement of the inner shell 3, the abutment portions 37 may be configured in any other way. For instance, they may be formed to extend inwards from the rear end portion of the tubular portion 31 of the inner shell 3 to come into contact with the rear end portion of the second body 2, or abutment portions 37 which are provided in a separate member may be fixedly welded to the inner shell 3.

(4) In the foregoing embodiment, the inner shell 3 and the outer shell 5 were formed by bending a single component. Instead, these may be formed of separate members.

(5) In the foregoing embodiment, the fixing portions 52*e* of the lateral walls 52 of the outer shell 5 were provided in the form of projections whereas the fixed portions 54*a* of the lateral portions 54 were provided in the form of through holes. Instead, any fixing arrangement may be employed as long as the lateral walls 52 and the lateral portions 54 can be fixedly retained to each other. Further alternatively, the lateral walls 52 and the lateral portions 54 need not be fixedly retained to each other.

(6) In the foregoing embodiment, a plurality of leg portions were provided in the inner shell 3 and the outer shell 5. However, the positions and the numbers of these leg portions are not particularly limited. Or, these may be omitted at all. Further, in the lower face of the first body 1, there were provided the two bottom face projections 19. However, the number of the bottom face projections 19 is not particularly limited. Or, these projections may be omitted entirely. Also, the shape and the number of the contact(s) 4 are not particularly limited. For example, only one contact 4 or three or more contacts 4 can be provided.

The invention claimed is:

1. A connector comprising:

a contact to be electrically connected to a connecting object;

a first insulating member having a front end portion to which the connecting object is connected and a rear end portion opposed to the front end portion, the first insulating member holding the contact;

a first metal member covering the first insulating member;

a second insulating member holding the first metal member;

a second metal member covering the first metal member and the second insulating member; and the first metal member forming a bulging portion which bulges outwards from a rear face of the first metal member, thus being in contact with an inner face of a rear portion of the second metal member.

2. The connector according to claim 1, wherein the bulging portion is provided in the form of a face.

3. The connector according to claim 1, wherein:

the second insulating member includes a groove formed in a direction perpendicular to a connecting direction of the connecting object; and the second metal member includes an inwardly projecting portion which is fitted within the groove.

4. The connector according to claim 1, wherein:

at the rear end portion of the first metal member, there is formed an abutment portion which abuts the second insulating member while being bound between the second insulating member and the second metal member;

movement of the first metal member toward the front end portion is prevented by abutment of the abutment portion to the second insulating member.

5. The connector according to claim 4, wherein:

the second insulating member is fitted over the first metal member along a connecting direction of the connecting object; and the abutment portion extends outwards from the rear end portion of the first metal member.

6. The connector according to claim 2, wherein:

the second insulating member includes a groove formed in a direction perpendicular to a connecting direction of the connecting object; and the second metal member includes an inwardly projecting portion which is fitted within the groove.

7. The connector according to claim 2, wherein:

at the rear end portion of the first metal member, there is formed an abutment portion which abuts the second insulating member while being bound between the second insulating member and the second metal member;

movement of the first metal member toward the front end portion is prevented by abutment of the abutment portion to the second insulating member.

8. The connector according to claim 3, wherein:

at the rear end portion of the first metal member, there is formed an abutment portion which abuts the second insulating member while being bound between the second insulating member and the second metal member;

movement of the first metal member toward the front end portion is prevented by abutment of the abutment portion to the second insulating member.

9. The connector according to claim 6, wherein:

at the rear end portion of the first metal member, there is formed an abutment portion which abuts the second insulating member while being bound between the second insulating member and the second metal member;

movement of the first metal member toward the front end portion is prevented by abutment of the abutment portion to the second insulating member.

10. The connector according to claim 7, wherein:

the second insulating member is fitted over the first metal member along a connecting direction of the connecting object; and the abutment portion extends outwards from the rear end portion of the first metal member.

11. The connector according to claim 8, wherein:

the second insulating member is fitted over the first metal member along the connecting direction of the connecting object; and the abutment portion extends outwards from the rear end portion of the first metal member.

12. The connector according to claim 9, wherein:

the second insulating member is fitted over the first metal member along the connecting direction of the connecting object; and the abutment portion extends outwards from the rear end portion of the first metal member.

* * * * *